US007009464B1

(12) United States Patent
Patel

(10) Patent No.: US 7,009,464 B1
(45) Date of Patent: Mar. 7, 2006

(54) WAVEGUIDE POLARIZER DIFFERENTIAL PHASE ERROR ADJUSTMENT DEVICE

(75) Inventor: Kanti N. Patel, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 40 days.

(21) Appl. No.: 10/776,091

(22) Filed: Feb. 10, 2004

(51) Int. Cl.
*H01P 1/163* (2006.01)

(52) U.S. Cl. ..... 333/21 A; 333/157

(58) Field of Classification Search ..... 333/21 A, 333/157; 343/756
See application file for complete search history.

(56) References Cited

U.S. PATENT DOCUMENTS 3,656,070 A * 4/1972 Monaghan et al. ..... 333/21 A
3,728,643 A * 4/1973 Chu ..... 333/21 A
3,914,764 A * 10/1975 Ohm ..... 342/366

* cited by examiner

*Primary Examiner*—Benny Lee
(74) *Attorney, Agent, or Firm*—McDermott Will & Emery LLP

(57) ABSTRACT

A phase error adjustment device configured to connect to an end of a waveguide polarizer and correct phase errors that the waveguide polarizer might generate. In accordance with this embodiment, the phase error adjustment device comprises an aperture having a height and a width, and changes in the dimension of the height or width will change the phase error adjustment quantity. In accordance with another embodiment of the invention, the phase error adjustment device comprises a thickness, and changes in the thickness will change the phase error adjustment quantity.

16 Claims, 4 Drawing Sheets

ETM-1 Measured Tx band (as built)

ETM-1 Measured RX Band(as built)

ETM-1 Measured with Phase trimming
Tx band

ETM-1 Measured with Phase triming
Rx band

WAVEGUIDE POLARIZER DIFFERENTIAL PHASE ERROR ADJUSTMENT DEVICE

BACKGROUND OF THE INVENTION

The present invention relates generally to a waveguide polarizer, and more specifically to waveguide polarizer differential phase error adjustment device.

Satellite antenna systems frequently utilize circularly polarized beams to send and receive communication signals. As one skilled in the art will appreciate, the circularly polarized beams can be generated in a number different of ways. For example, in many instances, a microwave polarizer can be used to convert linear polarized signals to circularly polarized signals. The polarizer essentially converts linearly polarized TE10 mode input signals into circularly polarized signals by decomposing the input linearly polarized signal (TE10 mode) into TE10 mode and TE01 mode signals and introducing a precise 90 degree phase shift between the two (TE10/TE01) modes. When the TE10 mode and TE01 mode signals propagate with equal amplitude and 90 phase difference, the signal is circularly polarized.

FIGS. 1*a* and 1*b* illustrate a well known corrugated square waveguide polarizer 100 used to create circularly polarized waves. This particular polarizer design simultaneously achieves a low input match of the TE10 and TE01 modes, as well as a precise 90-degree phase shift between the two orthogonal electric field modes over the usable frequency bands.

During design of the corrugated square waveguide polarizer 100, the 90-degree phase shift is accurately predicted using mode matching techniques and predictions confirmed by known measurements. Performance problems for the waveguide polarizer, however, can occur because of tolerances in the physical structure of the polarizer created during the manufacturing process. As one skilled in the art will appreciate, the phase shift is very sensitive to the fabricated dimensions of the polarizer.

In order to obtain less then 1 degree phase error, the polarizer needs to be fabricated with dimensional accuracy of <0.001" at Ku/Ka bands. These very tight manufacturing tolerances are extremely difficult to achieve on a consistent basis and performance essentially comes down to how well you can manufacture the polarizer. Even the best manufacturing processes typically will create polarizers with tolerance errors that make the polarizers inoperable at certain frequencies. Thus, a device and/or method is needed that will offset or fix the phase shift errors caused by manufacturing tolerance errors.

BRIEF SUMMARY OF THE INVENTION

One embodiment of the invention relates to a phase error adjustment device configured to connect to an end of a waveguide polarizer and correct phase errors that the waveguide polarizer might generate. In accordance with this embodiment, the phase error adjustment device comprises an aperture having a height and a width, and wherein changes in the dimension of the height or width will change the phase error adjustment quantity.

In accordance with another embodiment of the invention, the phase error adjustment device comprises a thickness, and changes in the thickness will change the phase error adjustment quantity. Further, in another embodiment, the phase error adjustment device has an outer shape that matches the outer shape of the end of the waveguide polarizer.

In accordance with yet another embodiment, the waveguide polarizer comprises a square waveguide polarizer. In some embodiments, the waveguide polarizer comprises a corrugated square waveguide polarizer, other square input/output polarizers, and the like. In addition, in another embodiment, the waveguide polarizer comprises an aperture, and the height and the width of the aperture of the phase error adjustment device is different from a height and a width of the waveguide polarizer aperture. In yet another embodiment, the material of the phase error adjustment device comprises the same material as the waveguide polarizer.

In accordance with another embodiment, the present invention relates to a device for converting a linearly polarized electromagnetic wave signal into a circularly polarized electromagnetic wave signal which comprises a TE10 mode signal and a TE01 mode signal. The TE10 mode signal and the TE01 mode signal have the same signal amplitude and are approximately 90 degrees out of phase. In accordance with this embodiment, the device comprises a waveguide polarizer adapted to convert the linear polarized electromagnetic wave signal into the circularly polarized electromagnetic wave signal. In addition, the device further comprises a phase error adjustment device connected to an end of the waveguide polarizer. The phase error adjustment device is adapted to correct phase errors that may be generated between the TE10 mode signal and the TE01 mode signal by the waveguide polarizer. Accordingly, the phase error adjustment device comprises an aperture having a height and a width, and changes in the dimension of the height or width will change the phase error adjustment quantity of the phase error adjustment device. In accordance with one embodiment, the phase error adjustment device is adapted to correct phase errors, so that the phase between the TE10 mode signal and the TE01 mode signal is approximately 90 degrees.

In accordance with yet another embodiment, the present invention relates to a method for adapting a waveguide polarizer to correct for manufacturing tolerances in the waveguide polarizer that might cause phase errors in the circularly polarized electromagnetic signals generated by the waveguide polarizer. In accordance with this embodiment, the method comprises: a) measuring phase errors in the circularly polarized signal caused by the waveguide polarizer; b) determining aperture dimensions of a phase error adjustment device that will correct the phase errors; and c) attaching the phase error adjustment device in cascade with the waveguide polarizer so that the phase errors are corrected, the phase error adjustment device having the aperture dimensions determined in the determining step.

In accordance with one embodiment of the invention, a circularly polarized electromagnetic signal comprises a TE10 mode signal and a TE01 mode signal, both signals having approximately the same signal amplitude and being approximately 90 degrees out of phase, and the phase error adjustment device is adapted to correct phase errors so that the phase between the TE10 mode signal and the TE01 mode signal is approximately 90 degrees.

A more complete understanding of the present invention may be derived by referring to the detailed description of preferred embodiments and claims when considered in connection with the figures.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION OF THE INVENTION

As noted above, waveguide polarizer manufacturing or fabrication errors may create phase errors in the circularly polarized signals generated by the polarizer. Thus, the present invention relates to devices and methods for correcting those phase errors. More specifically, the present invention involves cascading a separate external phase adjustment device (namely, phase trimmer) to compensate for the phase shift errors caused by imperfect manufacturing. The present invention also relates to methods for determining the phase shift errors, and compensating for those errors by manufacturing suitable phase adjustment devices.

Figure 1A:
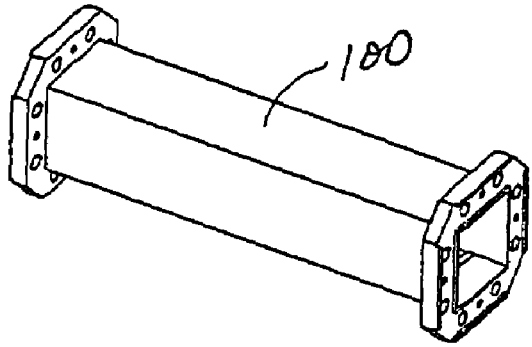
Fig. 1a (Prior Art)
FIG. 1*a* is perspective view of a prior art corrugated square waveguide polarizer.
Figure 1B:
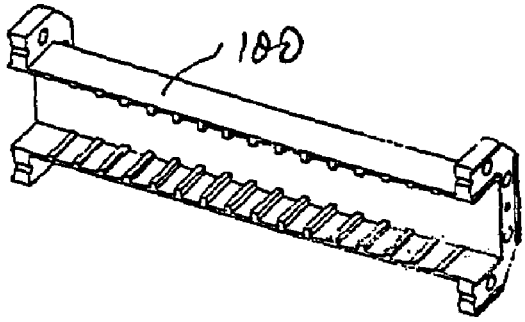
Fig. 1b (Prior Art)
FIG. 1*b* is a cross-sectional view of the polarizer of FIG. 1*a;*
Figure 2:
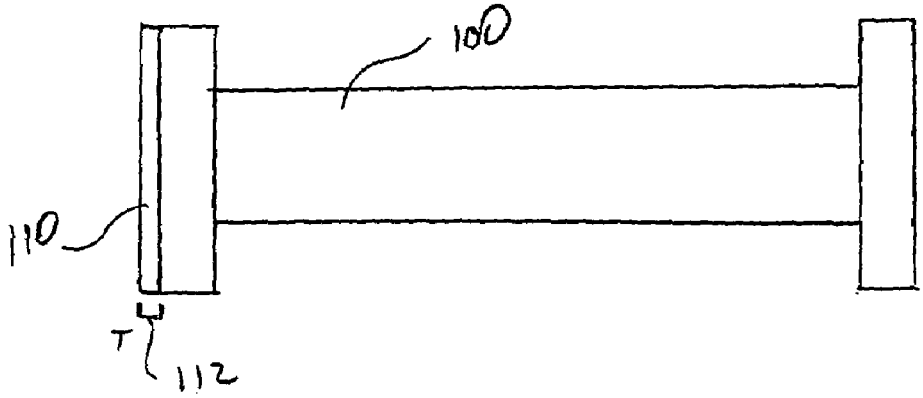
FIG. 2 side view of a square waveguide polarizer having one embodiment of a phase error adjustment device attached thereto.
Figure 3:
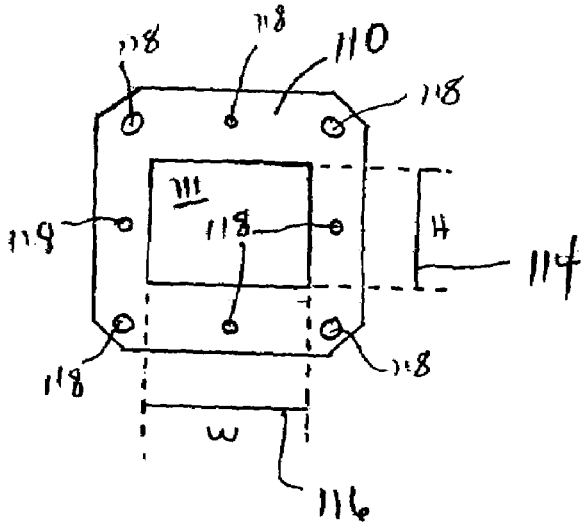
FIG. 3 is an end view of one embodiment of a phase error adjustment device in accordance with the present invention.

Referring now to FIGS. 2 and 3, one embodiment of waveguide polarizer 100 (see FIG. 2) and a phase adjustment device 110 is shown. In accordance with this embodiment, waveguide polarizer 100 comprises a corrugated waveguide polarizer. As one skilled in the art will appreciate, waveguide polarizer 100 can be manufactured using any suitable material that can propagate electromagnetic waves, such as aluminum, steel, or the like. In addition, while the illustrated embodiment shows a square waveguide polarizer, other suitable polarizer devices can be used, such as, for example, a septum polarizer, or the like.

In accordance with the illustrated embodiment, phase adjustment device 110 comprises a device that can be connected to an end of (i.e., in cascade with) waveguide polarizer 100. Phase adjustment device 110 includes an aperture 111 having a height ("H")114 and a width ("W" 116 (see FIG. 3), and device 110 has a thickness ("T") 112 (see FIG. 2). As discussed in more detail below, the phase adjustment qualities of phase adjustment device 110 can be changed by changing the dimensions of aperture 111 and/or the thickness ("T") 112. Also, as illustrated in FIG. 3, phase adjustment device 110 can be connected to waveguide polarizer 100 using any suitable fastener or fastening device, for example, using fasteners through attachment holes 118.

As discussed briefly above, phase adjustment device 110 is configured to offset or remedy any phase errors that a waveguide polarizer 100 may have as a result of manufacturing tolerances or other defects. As one skilled in the art will appreciate, for a circularly polarized wave, the phase between the TE01 mode signal and the TE10 mode signal should be 90 degrees or as close to 90 degrees as possible. The manufacturing tolerances or other defects many times will cause the phase between the TE01 mode and the TE10 mode to be sufficiently large that the wave is no longer circularly polarized. Phase adjustment device 10 will add phase lead or lag (+ or − phase adjustment), so that the phase between the two modes are as close to 90 degrees as possible. As mentioned above, adjusting the height 114 and/or width 116 of aperture 111, and/or adjusting the thickness 112 of phase adjustment device 110 will add the necessary phase lead or lag, as appropriate.

To determine the necessary dimensions for phase adjustment device 110, the phase errors for the waveguide polarizer 100 first are determined, which indicates the amount of phase lead or lag adjustment that is need. Then, modeling software can be used to calculate the phase adjustment device aperture dimensions 114, 116 and thickness 112 that will generate the necessary phase lead or lag.

Table 1 illustrates an example of how phase adjustment device 110 can correct phase shift errors across the widely separated frequency bands around 20/30 GHz. In this example, the predicted phase values are the expected phase shift values between the TE01 mode signal and the TE10 mode signal for a properly fabricated waveguide polarizer over various frequency values. As one can see, the predicted phase values are all within a degree or so of the desired 90 degree value. The "As Built" values show the actual phase values for a manufactured waveguide polarizer. As one can see, the "As Built" values are as much as 7 degrees off. By inserting a phase adjustment device 110, the actual phase values can be corrected so that they are close to 90 degrees, making the waveguide polarizer operable.

TABLE 1

Predict and Corrected Measured Differential Phase Shift

| | Frequency GHz | | | | | |
|---|---|---|---|---|---|---|
| Test Case | 19.70 | 19.95 | 20.20 | 29.50 | 29.75 | 30.00 |
| Predicted Phase (deg) | −91.2 | −90.1 | −89.1 | −89.0 | −90.3 | −90.4 |
| As Built Measured (deg) | −86.0 | −84.0 | −83.0 | −83.1 | −94.2 | −85.5 |
| Corrected with Device (deg) | −90.6 | −89.6 | −88.7 | −88.1 | −89.0 | −90.1 |
| Corrected Phase Error (deg) | 4.6 | 5.6 | 5.7 | 5.0 | 5.2 | 4.6 |

Figure 4A:
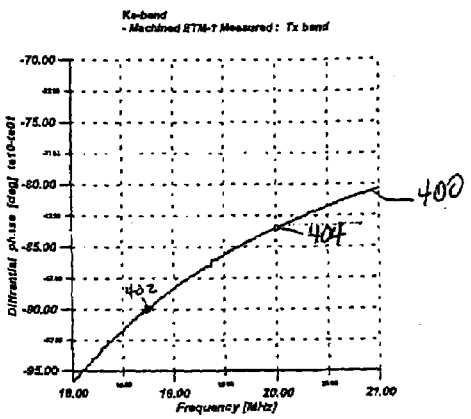
FIGS. 4*a* and 4*b* are graphs illustrating the differential phase versus frequency for unadjusted square waveguide polarizers.
Figure 4B:
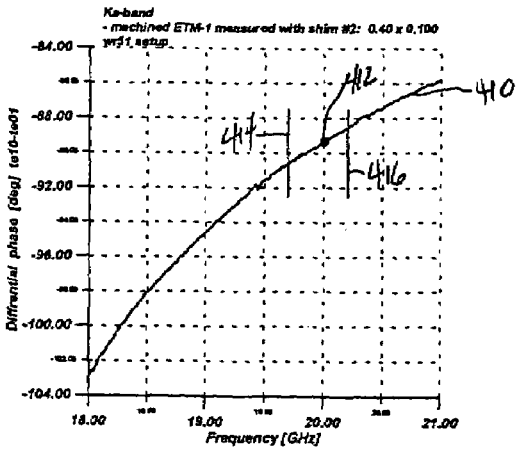

FIGS. 4*a*, 4*b*, 5*a*, and 5*b* illustrate additional examples of how phase adjustment device 110 corrects phase errors in polarizers. FIG. 4*a* shows a differential phase curve 400 for a manufactured waveguide polarizer. As one can see, the differential phase is near 90 degrees at the frequency of about 18.75 GHz (point 402). In this example, however, the operational frequency is around 20 GHz, which has a differential phase of about 83 degrees or so (point 404). A value well off of the desired 90 degrees. FIG. 4*b* shows a differential phase curve 410 for a waveguide polarizer that includes a phase adjustment device 110. As illustrated in this example, at the operating frequency of 20 GHz, the differential phase value is corrected so that it is about 89.5 degrees (point 412). In this example, with the phase adjustment device in place, the wave guide polarizer will have an operational frequency range between about 19.7 GHz and about 20.2 GHz (illustrated as lines 414 and 416).

Figure 5A:
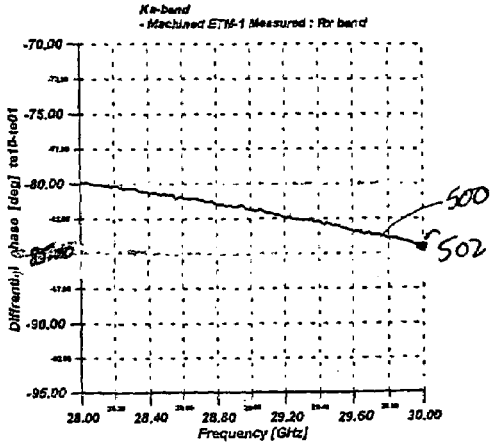
FIGS. 5*a* and 5*b* are graphs illustrating the differential phase versus frequency for the square waveguide polarizers of FIGS. 4*a* and 4*b*, respectively, but with phase error adjustment devices attached thereto.
Figure 5B:
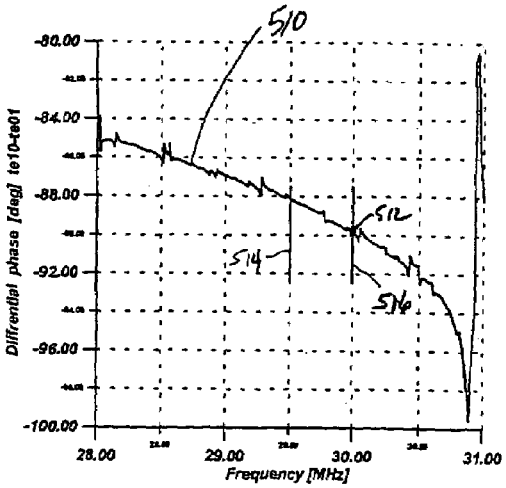

Similarly, FIGS. 5*a* and 5*b* illustrate an example for an operating frequency of about 30 GHz. In this example, FIG. 5*a* shows a differential phase curve 500 for a manufactured waveguide polarizer. As one can see, the differential phase is not close to 90 degrees for the illustrated operational frequency. For the operational frequency of about 30 GHz, the differential phase is about 85 degrees or so (point 502). Again, a value well off of the desired 90 degrees. FIG. 5*b* shows a differential phase curve 510 for a waveguide polarizer that includes a phase adjustment device 110. As illustrated in this example, at the operating frequency of about 30 GHz, the differential phase value is corrected so that it is about 90 degrees (point 512). In this example, with the phase adjustment device in place, the wave guide polarizer has an operational frequency range between about 29.5 GHz and about 30 GHz (illustrated as lines 514 and 516).

Figure 6:
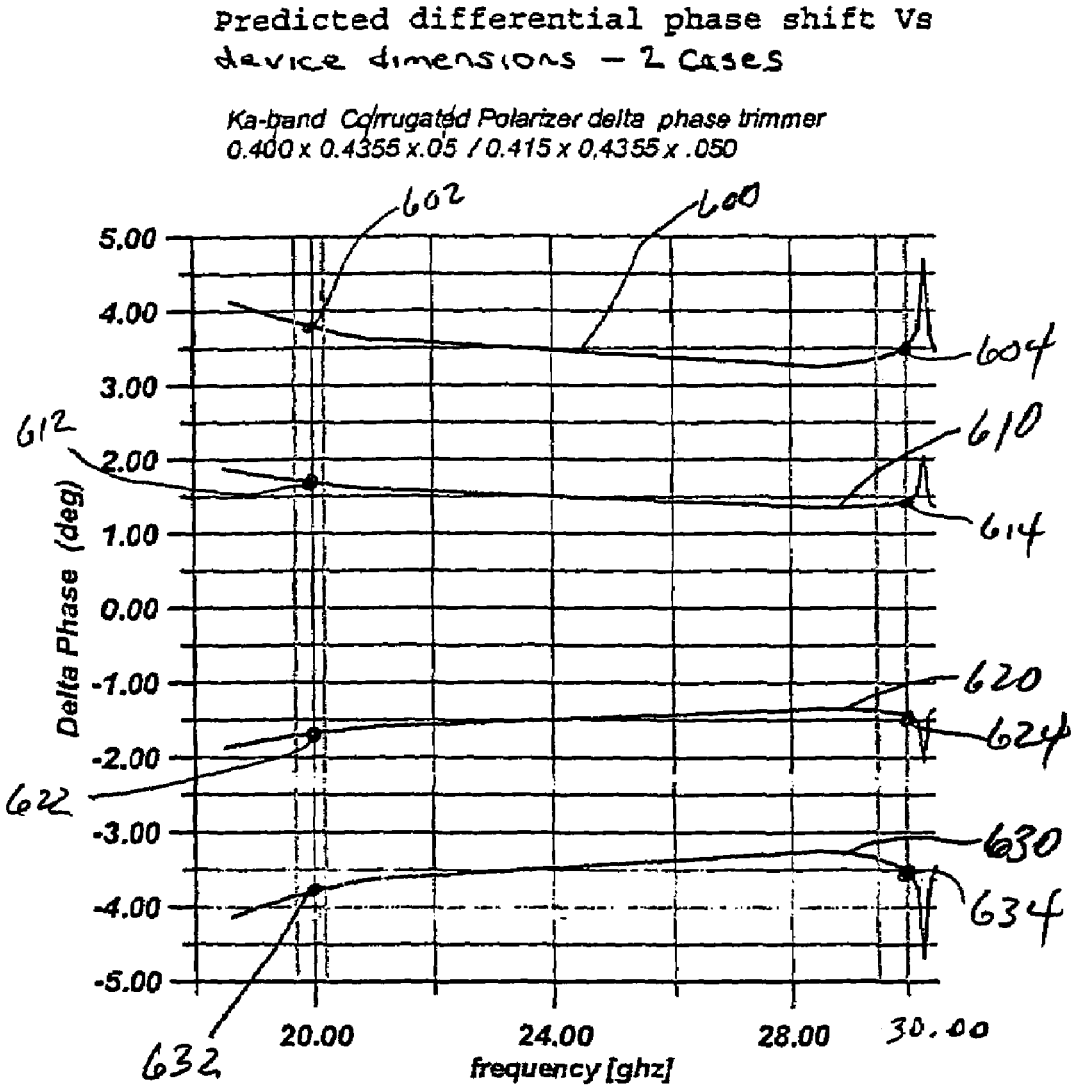
FIG. 6 is a graph illustrating predicted differential phase shift values versus corrugation depths for two embodiments of phase error adjustment devices.

Referring now to FIG. 6, a chart showing the amount that various phase adjustment devices will adjust phase is shown. In this chart, curve 600 illustrates the amount of phase adjustment for a phase adjustment device having an aperture height of 0.400 inches, an aperture width of 0.4355 inches and a thickness of 0.050 inches. As can be seen, this particular device provides a phase lead adjustment of about 3.75 degrees at 20.00 GHz (point 602) and about 3.5 degrees at 30.00 GHz (point 604).

Similarly, curve 610 illustrates the amount of phase adjustment for a phase adjustment device having an aperture height of 0.415 inches, an aperture width of 0.4355 inches, and a thickness of 0.05 inches. As can be seen, this particular device provides a phase lead adjustment of about 1.7 degrees at 20.00 GHz (point 612) and about 1.5 degrees at 30.00 GHz (point 614).

Curves 620 and 630 illustrate the amount of phase adjustment for the same devices as are illustrated by curves 610 and 600, respectively, except that the devices are rotated 90 degrees. Thus, curve 620 illustrates the amount of phase adjustment for a device having an aperture height of 0.4355 inches, an aperture width of 0.415 inches, and a thickness of 0.05 inches. This particular device provides a phase lag of about −1.7 degrees at 20.00 GHz (point 622) and about—1.5 degrees at 30.00 GHz (point 624); the same phase adjustment as curve 610 except a lag instead of a lead.

Similarly, curve 630 illustrates the amount of phase adjustment for a device having an aperture height of 0.4355 inches, an aperture width of 0.400 inches, and a thickness of 0.05 inches. This particular device provides a phase lag of about −3.75 degrees at 20.00 GHz (point 632) and about −3.5 degrees at 30.00 GHz (point 634). Again, the same phase adjustment as curve 600 except a lag instead of a lead.

In conclusion, the present invention provides devices and methods for correcting phase shift errors in waveguide polarizers. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

The invention claimed is:

1. A phase error adjustment device configured to connect to an end of a waveguide polarizer and correct phase errors of the waveguide polarizer, the phase error adjustment device comprising an aperture having a height and a width, wherein changes in the dimension of the height or width will change the phase error adjustment quantity, wherein the waveguide polarizer comprises a square waveguide polarizer.

2. A phase error adjustment device configured to connect to an end of a waveguide polarizer and correct phase errors of the waveguide polarizer, the phase error adjustment device comprising an aperture having a height and a width, wherein changes in the dimension of the height or width will change the phase error adjustment quantity, wherein the phase error adjustment device comprises a thickness, and wherein changes in the thickness will change the phase error adjustment quantity.

3. In a process for manufacturing a waveguide polarizer adapted to convert a linearly polarized electromagnetic signal into a circularly polarized electromagnetic signal, a method for adapting the waveguide polarizer to correct for manufacturing tolerances in a waveguide polarizer that might cause phase errors in the circularly polarized electromagnetic signals generated by the waveguide polarizer, the method comprising:

measuring phase errors in the circularly polarized signal caused by the waveguide polarizer;

determining aperture dimensions of a phase error adjustment device that will correct the phase errors; and attaching the phase error adjustment device in cascade with the waveguide polarizer so that the phase errors are corrected, the phase error adjustment device having the aperture dimensions determined in the determining step.

4. The method as recited in claim 3, wherein the material of the phase error adjustment device comprises the same material as the waveguide polarizer.

5. The method as recited in claim 3, wherein a circularly polarized electromagnetic signal comprises a TE10 mode signal and a TE01 mode signal, both signals having the same signal amplitude and being approximately 90 degrees out of phase, and wherein the phase error adjustment device is adapted to correct phase errors so that the phase between the TE10 mode signal and the TE01 mode signal is approximately 90 degrees.

6. The method as recited in claim 3, wherein the phase error adjustment device comprises a thickness, and wherein the method further comprises determining the thickness of the phase error adjustment device that will correct the phase errors.

7. The method as recited in claim 3, wherein the phase error adjustment device has an outer shape that matches the outer shape of the end of the waveguide polarizer.

8. The method as recited in claim 3, wherein the waveguide polarizer comprises a square input/output polarizer.

9. The method as recited in claim 3, wherein the waveguide polarizer comprises an aperture, and wherein the height and the width of the aperture of the phase error adjustment device is different from a height and a width of the waveguide polarizer aperture.

10. A device for converting a linearly polarized electromagnetic wave signal into a circularly polarized electromagnetic wave signal which comprises a TE10 mode signal and a TE01 mode signal, both signals having the same signal amplitude and being approximately 90 degrees out of phase, the device comprising:

a waveguide polarizer adapted to convert the linear polarized electromagnetic wave signal into the circularly polarized electromagnetic wave signal; and a phase error adjustment device connected to an end of the waveguide polarizer, the phase error adjustment device adapted to correct phase errors that may be generated between the TE10 a mode signal and the TE01 mode signal by the waveguide polarizer, the phase error adjustment device comprising an aperture having a height and a width, wherein changes in the dimension of the height or width will change the phase error adjustment quantity of the phase error adjustment device.

11. The device as recited in claim 10, wherein the waveguide polarizer comprises a square input/output polarizer.

12. The device as recited in claim 10, wherein the waveguide polarizer comprises an aperture, and wherein the height and the width of the aperture of the phase error adjustment device is different from a height and a width of the waveguide polarizer aperture.

13. The device as recited in claim 10, wherein the material of the phase error adjustment device comprises the same material as the waveguide polarizer.

14. The device as recited in claim 10, wherein the phase error adjustment device is adapted to correct phase errors so that the phase between the TE10 mode signal and the TE01 mode signal is approximately 90 degrees.

15. The device as recited in claim 10, wherein the phase error adjustment device comprises a thickness, and wherein changes in the thickness will change the phase error adjustment quantity.

16. The device as recited in claim 10, wherein the phase error adjustment device has an outer shape that matches the outer shape of the end of the waveguide polarizer.

* * * * *